United States Patent [19]

Brandis et al.

[11] Patent Number: 4,788,034

[45] Date of Patent: Nov. 29, 1988

[54] AGE HARDENABLE MAETENSITIC STEEL

[75] Inventors: Helmut Brandis; Paul Gümpel, both of Krefeld, Fed. Rep. of Germany

[73] Assignee: Thyssen Edelstahlwerke AG, Krefeld, Fed. Rep. of Germany

[21] Appl. No.: 87,853

[22] Filed: Aug. 21, 1987

[30] Foreign Application Priority Data

Aug. 21, 1986 [DE] Fed. Rep. of Germany ..... 3628395

[51] Int. Cl.[4] ..... C22C 39/20; C22C 38/04

[52] U.S. Cl. ..... 420/075; 420/072; 420/073; 420/074; 148/329

[58] Field of Search ..... 420/72, 73, 74, 75; 148/329

[56] References Cited

U.S. PATENT DOCUMENTS

| | | | |
|---|---|---|---|
| 2,683,677 | 7/1954 | Walters, Jr. et al. | 148/21.54 |
| 3,392,064 | 7/1968 | Kattus et al. | 148/12.3 |
| 3,711,276 | 1/1973 | Hellner | 75/128 A |
| 4,358,315 | 11/1982 | Jones et al. | 75/123 N |

FOREIGN PATENT DOCUMENTS

| | | | |
|---|---|---|---|
| 0143873 | 6/1985 | European Pat. Off. | 420/75 |
| 55-138059 | 10/1980 | Japan . | |
| 0016145 | 1/1982 | Japan | 420/75 |
| 0185958 | 11/1982 | Japan | 420/75 |
| 0834213 | 5/1981 | U.S.S.R. | 420/75 |

*Primary Examiner*—Upendra Roy

*Attorney, Agent, or Firm*—Cushman, Darby & Cushman

[57] ABSTRACT

A martensite steel, especially for plastic molds, of the following compositions:

0.001 to 0.1% carbon
0.50 to 2.0% silicon
8.0 to 14.0% manganese
0.3 to 5.0% titanium
0.001 to 1.0% aluminum
0 to 2.0% chromium
0 to 3.0% molybdenum
0 to 4.0% nickel
0 to 4.0% tungsten
0 to 5.0% cobalt
remainder iron, including impurities caused by manufacture.

3 Claims, 4 Drawing Sheets

Influence of nickel on the aging behavior of manganese steels

Temperatures of the transformation start for the γ⇌α and γ⇌ε transformations. (According to A.R. Troiano and F.T. McGuire, "Trans. Amer. Soc. Met." vol. 31, 1943, pp. 340-364).

Influence of silicon on the aging behavior of manganese steels

Influence of nickel on the aging behavior of manganese steels

Influence of titanium on the aging behavior of manganese steels

AGE HARDENABLE MAETENSITIC STEEL

The invention relates to an economical age hardened martensite steel, especially for the production of plastic molds.

The steel should exhibit a strength of 900 to 1100 N/mm$^2$ in the solution heat treatment state and therefore be easy to work. A simple aging treatment at 400° to 500° C. should make it possible to achieve tensile strength values of at least 1200 N/mm$^2$.

BACKGROUND OF THE INVENTION

For the manufacture of molds for the manufacture of shaped plastic articles, plastic mold steel 40 CrMnMo 7, work material no. 1.2311 or the variant alloyed with sulfur, 40 CrMnMoS 86, work material no. 1.2312 are primarily used. These steels are quenched and tempered by the manufacturer to tensile strength values of 900 to 1100 N/mm$^2$ and processed in this state into molds or tools. A subsequent heat treatment of the tools would result in unacceptable dimensional changes, distortions or surface impairments. As a consequence, the quenching and tempering strength remains limited at 1100 to 1200 N/mm$^2$ because higher strengths would make it more difficult to machine the steel.

The traditional martensite steels with 18% nickel, 8% cobalt, 5% molybdenum and up to 1.4% titanium, which exhibit a tensile strength of approximately 1000 N/mm$^2$ in the solution heat treatment state and which can be aged to strengths above 2000 N/mm$^2$, are considered for the production of plastic molds only to a limited extent, because of their high alloy content and the associated expenses.

SUMMARY OF THE INVENTION

The object of the present invention is to provide a steel which exhibits a low strength and thus good machinability in its delivered state and which, after manufacture into tools, can be brought to a strength of at least 1200 N/mm$^2$ by means of a simple heat treatment which does not result in any dimensional change or surface change.

In order to provide these properties, the present invention provides a steel with the following composition (percentages are by weight):

0.001 to 0.1% carbon
0.50 to 2.0% silicon
8.0 to 14.0% manganese
0.3 to 5.0% titanium
0.001 to 1.0% aluminum
0 to 2.0% chromium
0 to 3.0% molybdenum
0 to 4.0% nickel
0 to 4.0% tungsten
0 to 5.0% cobalt
remainder iron, including impurities caused by manufacture.

The steel of the invention is an iron alloy with 8 to 14 per cent manganese as the main component in addition to iron. Manganese contents of only 8% provide advantageous properties and the optimum manganese content is approximately 12%. Furthermore, the steel is enriched with alloying elements which are dissolved in the austenite when heated to temperatures above 800° C. and which also remain dissolved in the martensite after having been cooled to room temperature. These alloying elements are a combination of C, Si, Ti and Al as obligatory components and Mo, W, Co and Ni as optional components.

The silicon content of at least 0.5% is necessary in order to obtain sufficiently high hardening values even at realistic aging times of 10 to 20 hours (see FIG. 2). A strengthening of this effect without adversely affecting the ductility is achieved by the addition of nickel, which should be on the order of 1 to 2% (see FIG. 3). Titanium is considerably involved in the formation of intermetallic phases and therefore contributes essentially to increasing the hardness (see FIG. 4). Molybdenum is used just as titanium to increase the hardness, which causes no appreciable impairment of the ductility. It is possible to separate these dissolved alloying elements from the martensite by aging at temperatures of around 500° C. between cooling off and heating, because of the transformation hysteresis (see FIG. 1). The intermetallic phases which this produces result in an increase of hardness. This process is designated as martensite aging.

A preferred compositions is as follows (percentages are by weight):

less than 0.05% carbon
0.5 to 1.5% silicon
10.0 to 14.0% manganese
0.3 to 1.5% molybdenum
0.3 to 2.5% nickel
0.3 to 3.0% titanium
0.01 to 0.4% aluminum
remainder iron, including impurities caused by manufacture.

A more preferred composition is as follows (percentages are by weight)

0.008% carbon
0.7% silicon
12.0% manganese
1.0% molybdenum
2.0% nickel
0.1% aluminum
1.0% titanium
remainder iron, including impurities.

BRIEF DESCRIPTION OF FIGURES OF DRAWING

DETAILED DESCRIPTION OF PREFERRED EMBODIMENT

Figure 1:
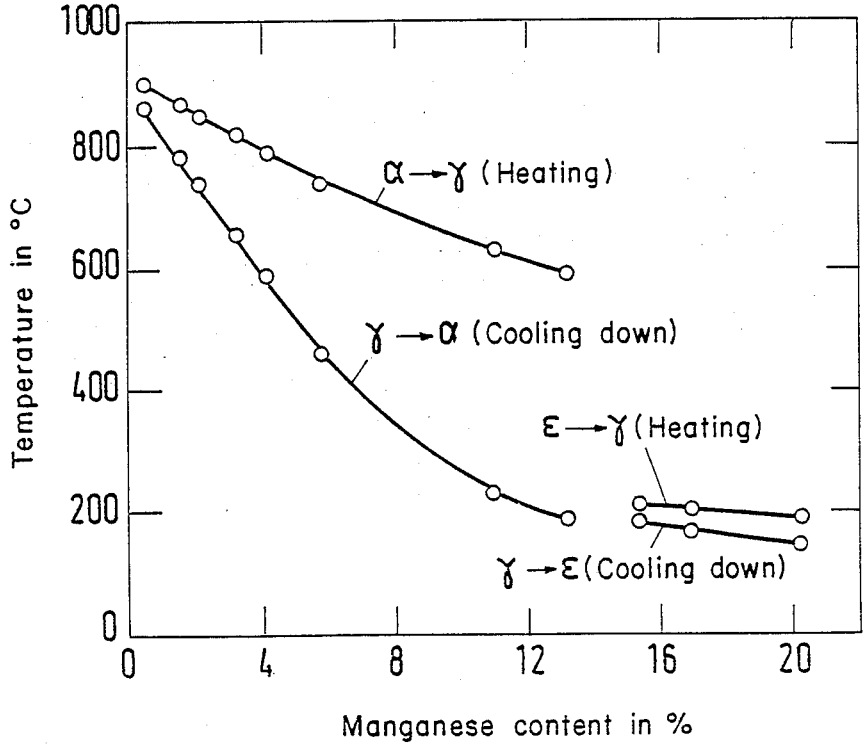
FIG. 1 is a graph which illustrates the effect of aging temperature and manganese content.
Figure 2:
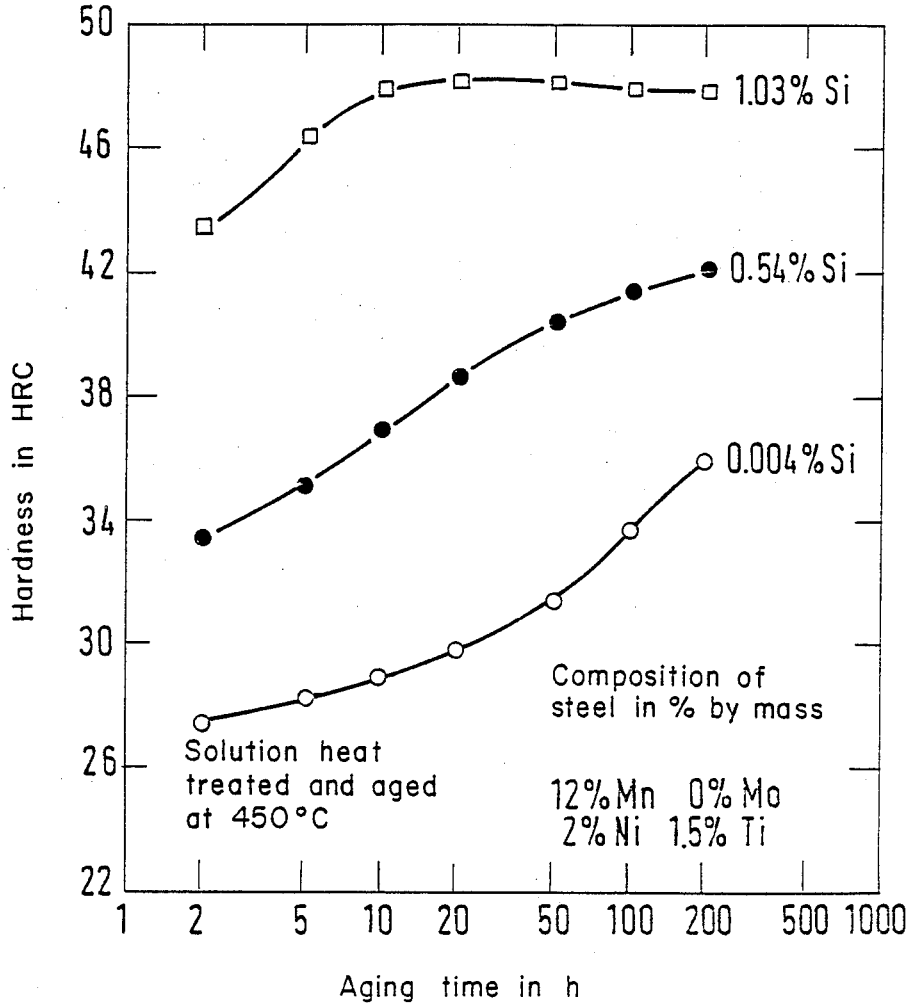
FIG. 2 is a graph which illustrates the influence of silicon content on the aging behavior of the steel.
Figure 3:
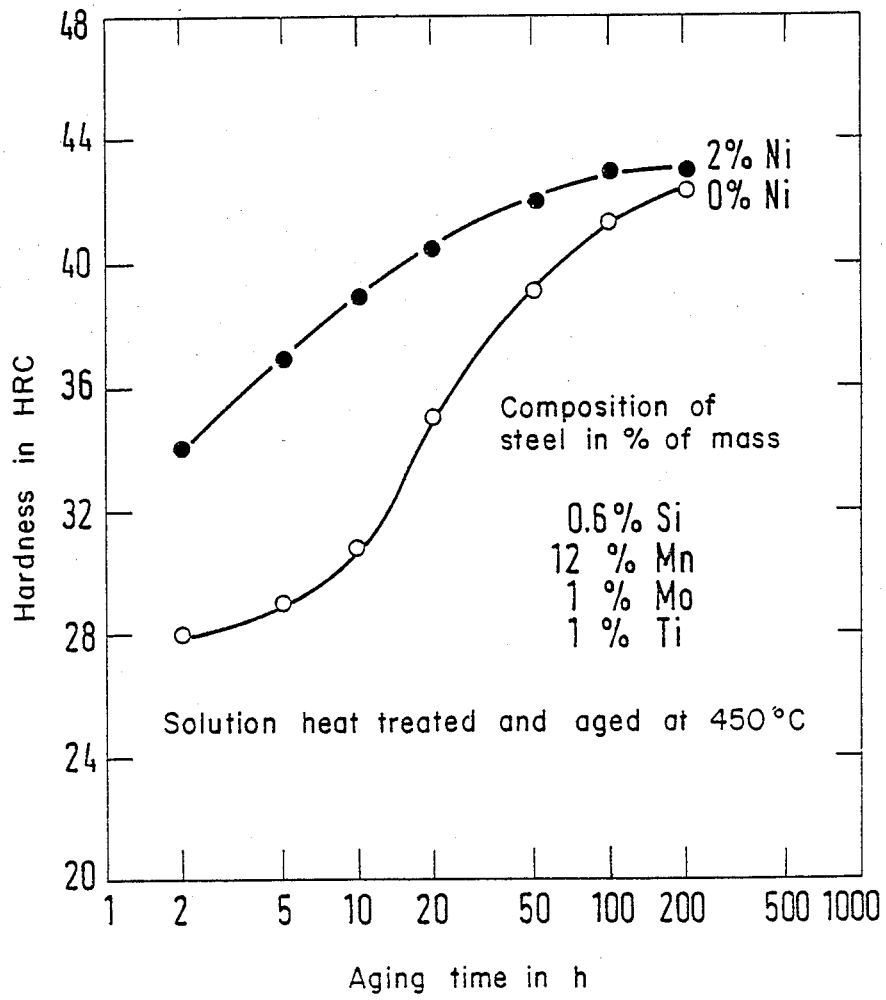
FIG. 3 is a graph which illustrates the influence of nickel content on the aging behavior of the steels.
Figure 4:
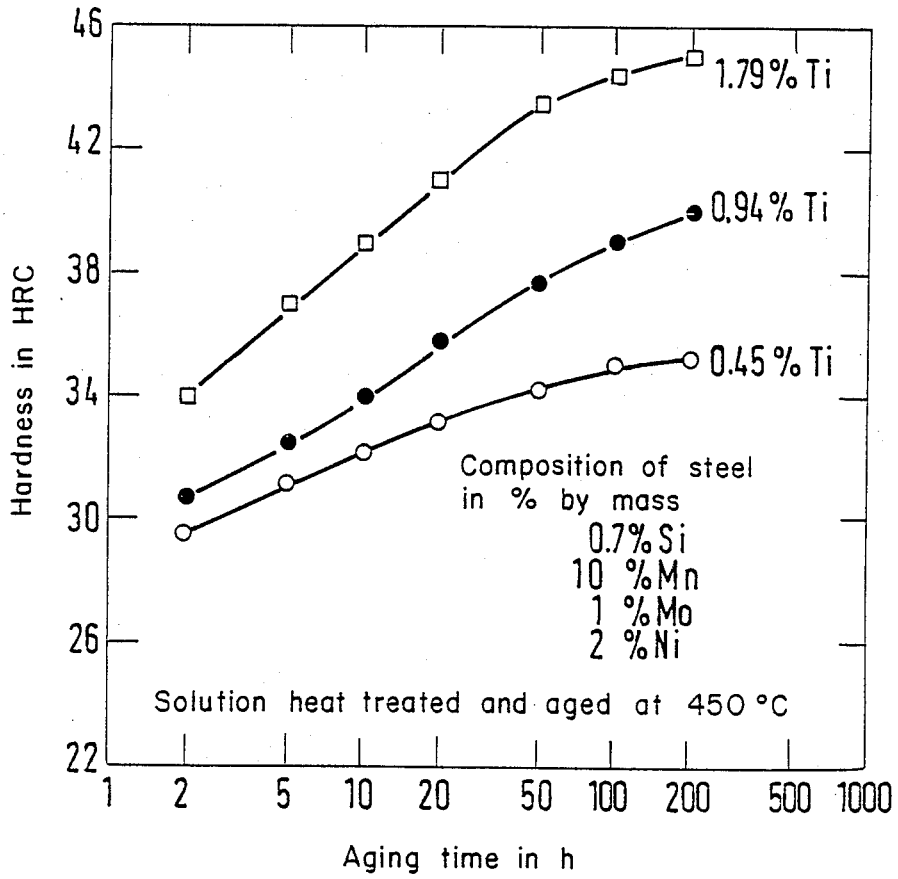
FIG. 4 is a graph which illustrates the effect of titanium content on the aging behavior of the steels.

The invention is illustrated by the following example:

EXAMPLE

A steel with the following composition (percentages by weight):

0.008%; carbon
0.7% silicon
2.0manganese
1.0%; molybdenum
2.0% nickel
0.1% aluminum
1.0% titanium
remainder iron including impurities was melted under normal operating conditions and poured into blocks of 4 tons. The deformation, mechanical working, polishing and etching of this steel presented no problems. Plastic molds produced from this steel were subjected to practical testing and have completely proven themselves in usage.

What is claimed is:

1. A mold for casting plastics comprised of a martensitic steel with the following composition (in % by weight):

0.001 to 0.1% carbon
0.50 to 2.0% silicon
8.0 to 14.0% manganese
0.3 to 5.0% titanium
0.001 to 1.0% aluminum
0 to 2.0% chromium
0 to 3.0% molybdenum
0 to 4.0% nickel
0 to 4.0% tungsten
0 to 5.0% cobalt
remainder iron, including impurities caused by the manufacture.

2. A mold for casting plastics comprised of a martensitic steel according to claim 1 with the following composition (in % by weight):

less than 0.05% carbon
0.5 to 1.5% silicon
10.0 to 14.0% manganese
0.3 to 1.5% molybdenum
0.3 to 2.5% nickel
0.3 to 3.0% titanium
0.01 to 0.4% aluminum
remainder iron, including impurities caused by the manufacture.

3. A mold for casting plastics comprised of a martensitic steel according to claim 2 with the following composition (in % by weight):

0.008% carbon
0.7% silicon
12.0% manganese
1.0% molybdenum
2.0% nickel
0.1% aluminum
1.0% titanium
remainder iron, including impurities.

* * * * *